US005258654A

United States Patent [19]

Roberts et al.

[11] Patent Number: 5,258,654

[45] Date of Patent: Nov. 2, 1993

[54] COMPUTER-CHECKING OF THE POSITION OF A SWITCH WHOSE CONTACTS WHERE OXIDIZED

[75] Inventors: Patrick S. Roberts, Rolling Meadows; Bay E. Estes, Palatine, both of Ill.

[73] Assignee: Eaton Corporation, Cleveland, Ohio

[21] Appl. No.: 860,475

[22] Filed: Mar. 30, 1992

[51] Int. Cl.[5] ..... H01H 1/60

[52] U.S. Cl. ..... 307/125; 307/137; 307/134

[58] Field of Search ..... 361/235, 233; 307/137, 307/135, 125

[56] References Cited

U.S. PATENT DOCUMENTS 3,794,850 2/1974 Hirose ..... 307/137

4,851,707 7/1989 Lindsay ..... 307/137

*Primary Examiner*—A. D. Pellinen

*Assistant Examiner*—Aditya Krishnan

*Attorney, Agent, or Firm*—C. H. Grace

[57] ABSTRACT

A precharged capacitor connected in parallel with the contacts of an open switch discharges through the switch upon closure. Oxides on the switch contacts are broken through upon closure of the switch to produce a good electrical connection. The capacitor provides sufficient voltage and transient current to clean the switch contacts. A microprocessor having signals of only 5 volts can interrogate a plurality of such switches by multiplexing some semiconductor switching circuits that energize the interrogated switches and by synchronously multiplexing some microprocessor input circuits. The microprocessor's input circuits therefore receive signals indicating the status of each switch in turn.

4 Claims, 2 Drawing Sheets

COMPUTER-CHECKING OF THE POSITION OF A SWITCH WHOSE CONTACTS WHERE OXIDIZED

FIELD OF THE INVENTION

The field of the invention is circuitry for electrical switches that are employed for switching such small currents and/or voltages that oxides or other contaminants on the contacts of the switches may tend to prevent them from making good connections.

SUMMARY OF THE INVENTION

Switches designed for use in switching 120-volt circuits (for example) may sometimes be utilized in circuits in which much lower voltages, for example 5 volts DC, are employed. Such low voltages cannot be relied upon to break through oxide layers on the switch contacts and make good low-resistance connections.

For example, in a control system, a pressure-actuated switch arranged for sensing a liquid level may be polled periodically be a microprocessor to ascertain whether the switch is open or closed. The interrogating signal of the microprocessor may be only 5 volts. However, a contact voltage and current of at least 24 volts and several milliamperes must be applied to the switch contacts, at least at the time of closure, to ensure that a closed switch is read as being closed.

Some prior art apparatus has employed a 120-volt power source in an interrogating circuit that passes a current through the contacts and has the current actuate an optical coupling device. The low-voltage output of the optical coupling device in turn provides a switch-status signal to the microprocessor. Such prior apparatus is expensive.

The invention described below cleans the switch contacts, by applying a great enough voltage and current through the contacts to break through surface contaminants. The great current is provided by a capacitor that discharges transiently through the contacts immediately when they close. Some time after closure the steady-state current need only be great enough to measure the status of the switch, and can therefore can be much smaller than would have been required to break through the contaminant.

Accordingly, one object of the invention is to provide apparatus for cleaning the contacts of a switch upon their closure by providing a capacitor in parallel across the contacts, which is charged by a power source while the contacts are open and which discharges through the contacts when they close.

Another object is to provide in addition a sensing circuit responsive to sense a signal indicative of the position of the switch and an output-coupling diode to conduct such a signal from a switch contact to the sensing circuit.

Another object is to provide another switch (e.g. a semiconductor switch) for connecting the power source to the interrogated switch when the status of the interrogated switch is to be read.

Another object is to provide a multiplexer for sequentially interrogating several switches and synchronously reading their statuses, with contact cleaning in advance of the interrogation so that a reliable status indication is obtained when the switch is closed.

Still more objects of the invention will be apparent from the following text and drawings, which describe an example, and from the claims.

DESCRIPTION OF A PREFERRED EMBODIMENT

Figure 1:
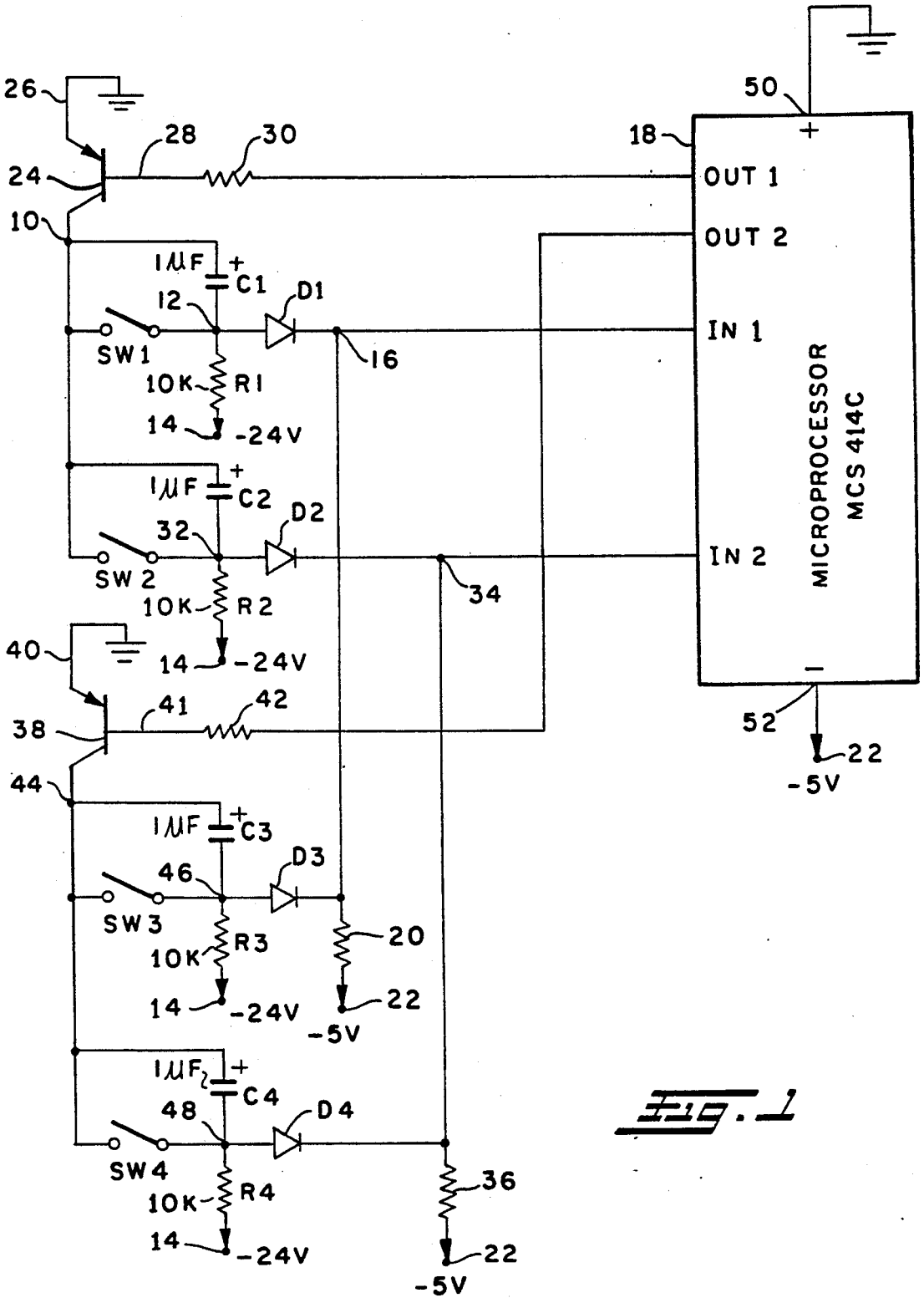
FIG. 1 is a schematic circuit diagram of a preferred embodiment of the invention.

In an example of a preferred embodiment of the invention shown in FIG. 1, pressure-actuated switches SW1, SW2, SW3 and SW4 open and close in response to a rising and falling water level. At certain times, determined by a program, the status of each of the switches is examined by a microprocessor 18. The process of automatically detecting the open or closed statuses of the switches sequentially is sometimes referred to herein as "polling" of the switches.

SW1 Subcircuit

The switch SW1 has terminals 10 and 12 (FIG. 1). A capacitor C1 is connected from terminal 10 to junction 12 in parallel with the contacts of switch SW1. Junction 12 is also connected to a resistor R1 whose other terminal is maintained at −24 volts DC. Reference number 14 refers to a 24-volt power supply.

Also connected to junction 12 is the anode of a diode D1, whose cathode terminal 16 is connected to an input terminal IN1 of the microprocessor 18. Terminal 16 is also connected to a −5 volt DC power supply, reference number 22.

Terminal 10 is also connected to the collector of a PNP transistor 24, whose emitter electrode 26 is grounded. A base electrode 28 of the transistor 24 is connected through a resistor 30 to an output terminal OUT1 of the microprocessor 18.

SW2 Subcircuit

The collector of transistor 24 is also connected to another subcircuit, which is similar to the one described above. Terminal 10 goes to a switch SW2 and a capacitor C2, both of whose other terminal is connected to a junction 32. The junction 32 is connected to a resistor R2, whose other end is connected to the −24 volt terminal 14.

Junction 32 is also connected through an output-coupling diode D2 to a terminal 34, which is connected to another input terminal IN2 of the microprocessor 18. Terminal 34 is also connected to a resistor 36, whose other end goes to the −5 volt supply terminal 22.

SW3 and SW4 Subcircuits

Another PNP transistor 38 controls two more switch subcircuits. They involve switches SW3 and SW4, whose connections are identical to those described above. The emitter 40 of the transistor 38 is grounded. The base 41 of transistor 38 is connected through a series resistor 42 to a second output terminal OUT2 of the microprocessor 18.

The collector 44 of transistor 38 is connected to a capacitor C3, the switch SW3, a capacitor C4, and the switch SW4. Capacitor C3 and switch SW3 have their other terminals connected at a junction 46 to a resistor R3 that goes to the −24 volt DC terminal 14. The anode of a diode D3 is also at the junction 46 and its cathode is at terminal 16.

In a similar manner one terminal of switch SW4 and one terminal of the capacitor C4 are connected to collector 44. Another terminal of SW4, another terminal of C4, the anode of a diode D4, and a resistor R4 are connected to a junction 48. The other end of resistor R4 is connected to the −24 volt supply 14. The cathode of diode D4 is connected to the terminal 34.

Microprocessor

The microprocessor 18 has also a terminal 50, which is grounded and a terminal 52, which is connected to the −5 volt power supply terminal 22. It has several other terminals which need not be described in order to explain the present example of the invention. The microprocessor 18 is a model MCS 414C manufactured by Hitachi Corp. of San Jose, Calif.

Programming of the microprocessor 18 to perform the multiplexing described herein is very well known in the prior art, so details of the program's steps are omitted.

Operation of the Circuit

Upon power up, i.e., application of power to the system as a whole, the microprocessor 18 pulls low both of its outputs, i.e. OUT1 and OUT2. See FIG. 1. When OUT1 is at its low logic level the base terminal 28 of transistor 24 conducts current provided by the emitter 26. That turns on transistor 24 and current flows from emitter 26 to the collector terminal 10.

Assuming that the switches SW1, SW2, SW3 and SW4 are open upon power-up of the whole system, capacitors C1 and C2 are charged by current flow through the switching means 24 and through resistors R1 and R2, putting a positive charge on terminal 10 of each capacitor C1, C2.

Capacitors C3 and C4 are similarly charged through transistor 38 and resistors R3 and R4. During this time, any signals that may occur at junctions 12, 32, 46 or 48, which are connected through the output diodes D1, D2, D3 and D4 to the input terminals IN1 and IN2 of the microprocessor 18, are ignored by the microprocessor.

Contact Cleaning

Subsequently, when SW1, SW2, SW3, or SW4 closes, the closure discharges the corresponding capacitor C1, C2, C3, C4 through the switch contacts, reducing the capacitor's 24-volt charge to 0 volts. Upon closure a great current flows from the capacitor through the contacts. That transient current, along with the voltage of the capacitor on the switch contacts, provides sufficient current and voltage to clean the contacts. If there were an oxide layer there that would otherwise have prevented a low resistance through the closed switch, the layer would be broken through and good contact would be made.

Multiplex Reading of Switch Status

After the capacitors C1, C2, C3 and C4 are charged, multiplexing takes place in the course of normal operation of the pressure switches, under the control of a program stored in the microprocessor 18. Microprocessor 18 pulls OUT1 and OUT2 to normally high states. The switches are interrogated periodically to ascertain whether they are open or closed, in the following sequence. First the microprocessor pulls OUT1 low, making transistor 24 conductive and creating an approximately ground-level potential at terminal 10. The microprocessor 18 then reads the signal at terminal 16 (IN1), after which it reads the signal at terminal 34 (IN2).

The microprocessor 18 then releases the OUT1 signal (its potential goes up), cutting off conduction of transistor 24, and asserts (pulls low) OUT2. The microprocessor 18 reads the inputs at IN1 and IN2 again, to inspect the signals that are created at terminals 16 and 34 by switches SW3 and SW4 respectively.

In the case of a switch that is in a closed status during its multiplex reading cycle, its input to the microprocessor 18 (e.g., IN1) has a logic high signal. If the switch is open when its multiplexing turn comes, the input signal to the microprocessor 18 is low. The reasons are as follows.

When the signal at OUT1 is low and transistor 24 is conductive, terminal 10 is at approximately ground potential. If SW1 is open and C1 is fully charged, junction 12 is at approximately −24 volts, because no current is flowing through resistor R1. The diode D1 is then back-biased because its cathode terminal 16 has a bias of only −5 volts from terminal 22 (through resistor 20). Diode D1 does not conduct and IN1 has a signal of −5 volts.

Thus, when switch SW1 is open, diode D1 blocks to prevent the −24 volts from damaging the microprocessor's input circuits.

When transistor 24 is conductive and SW1 is closed, junction 12 has an approximately ground-level potential, and resistor R1 has a voltage drop of about 24 volts. The diode D1 is forward-biased and current flows through D1 from junction 12 to terminal 16, and thence through resistor 20 to the −5 volt terminal 22. The voltage drop on the resistor 20 is then approximately 5 volts and the potential at terminal 16 is approximately ground level. The input terminal IN1 of microprocessor 18 then has an approximately ground-level-potential signal, which is read by the microprocessor in a predetermined time interval of the multiplexing cycle.

Subcircuits connected with switches SW2, SW3, and SW4 operate in the same manner as the subcircuit of SW1 so it is not necessary to describe their operation.

Timing Diagram

Figure 2:
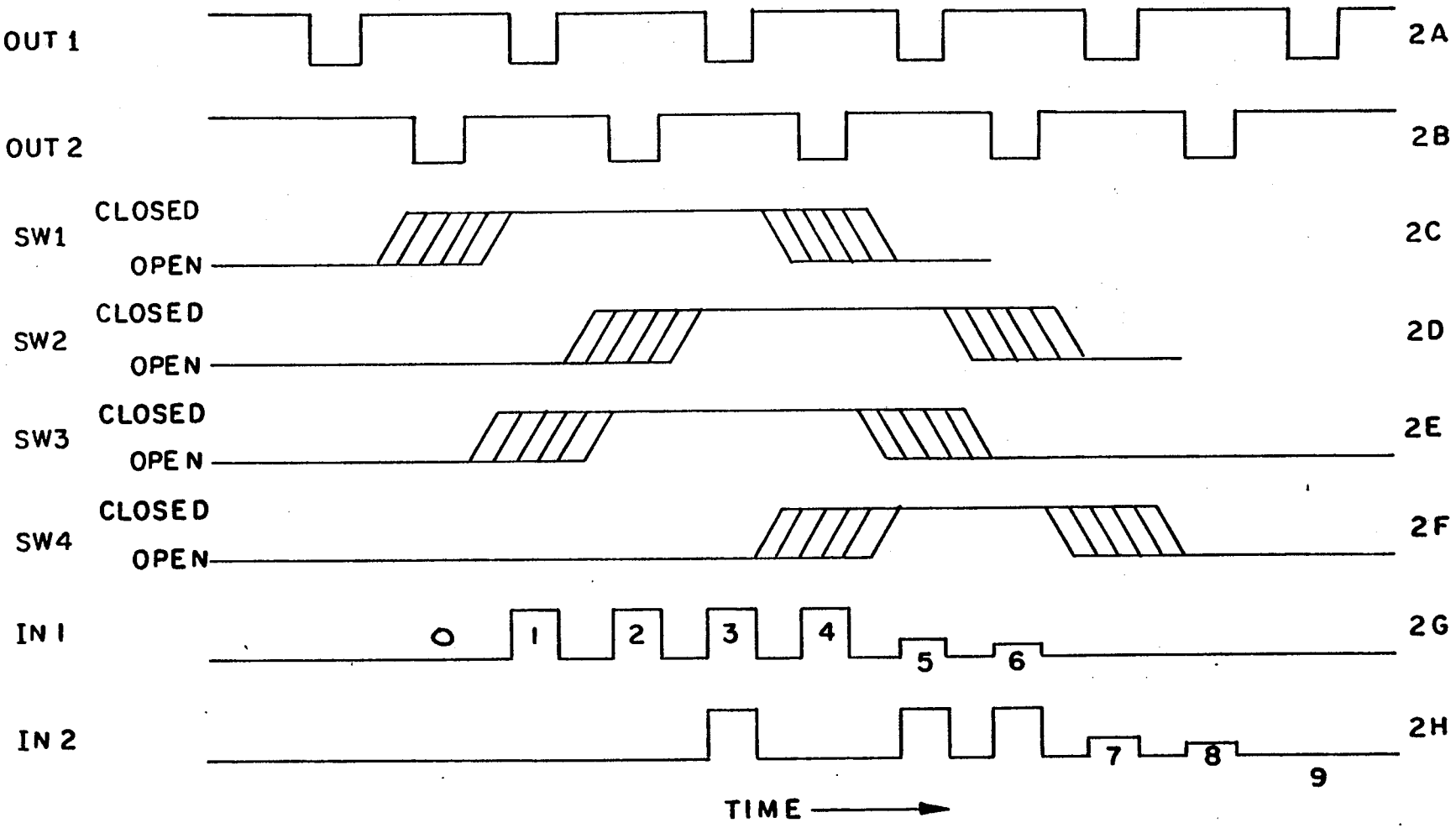
FIG. 2 is a timing diagram showing relative times of occurrences of various events, on rows 2A through 2H, during a typical operating cycle of the preferred embodiment.

In FIG. 2 eight rows of graphs, 2A–2H, show behaviors at eight points in the circuit as functions of time. Any vertical line passing through the rows 2A–2H represents the same instant of time on the graphs of all of the rows.

Row 2A of FIG. 2 shows a down-going pulse OUT1 having a 25% duty cycle. The high logic level has sufficient voltage to block conduction of transistor 24 in the circuit of FIG. 1. The low logic level is low enough to turn on transistor 24, which functions as a semiconductor switch.

Row 2B shows a down-going pulse train OUT2 of 25% duty cycle having a 180-degree phase relationship with the signal of row 2A.

Row 2C shows the open or closed status of switch SW1 as an example of its operation when the water level rises and falls.

The open and closed time pattern of switch SW2 is shown on row 2D and the openings and closings of switches 3 and 4 are shown on rows 2E and 2F.

Row 2G shows the signal voltage at the input terminal IN1 of microprocessor 18. The input voltage at terminal IN2 is shown in row 2H. In rows 2G and 2H the high level is approximately (slightly less than)

ground potential, and the low level is approximately −5 volts, as set by terminal 22 of FIG. 1.

Sequence of Operation of FIG. 2 Example

The events portrayed in the timing diagram of FIG. 2 are as follows, where the time intervals described are numbered 0 through 9.

At time interval 0 the OUT2 terminal has a down-going pulse (row 2A) that makes transistor 38 conductive in order to interrogate switches SW3 and SW4. Those switches are open (rows 2E, 2F) so the signals at junctions 46 and 48 are −24 volts. The signals at the cathode ends of diodes D3 and D4, i.e. at terminals 16 and 34, are therefore −5 volts. The signals of the microprocessor's input terminals IN1 and IN2 are low logic levels, as shown on rows 2G and 2H of FIG. 2.

At time interval 1, OUT1 is low (row 2A). Transistor 24 connects approximately ground voltage to terminal 10. SW1 is closed, as shown on row 2C at time interval 1, and SW2 is open, as shown on row 2D. Junction 12 is therefore at approximately ground potential and junction 32 is at −24 volts. Diode D1 conducts to terminal 16 and diode D2 blocks. As shown on row 2G, IN1 has a high signal (i.e., slightly below ground potential) and as shown on row 2H, IN2 has a low-level signal (about −5 volts).

In time interval 2, OUT2 goes low as shown on row 2B, making transistor 38 conductive. Switch SW3 has closed by that time, (row 2B) and SW4 is still open, as shown on row 2F. Diode D3 is therefore conducting and diode D4 is blocking. As shown on rows 2G and 2H, IN1 receives a high logic-level signal and IN2 a low signal.

At time interval 3, OUT1 goes low, (row 2A), making transistor 24 conductive. By this time switch SW2 has also closed, (row 2D). Diodes D1 and D2 are both conductive because both junctions 12 and 32 are only slightly below ground potential. High signals appear at terminals IN1 and IN2, as shown on rows 2G and 2H.

In time interval 4, OUT2 goes low. Switch SW3 is still closed and SW4 has not closed as yet (in this particular example) consequently the same signals appear at IN1 (high) and IN2 (low) as appeared in time interval 2.

In time interval 5, OUT1 interrogates switches SW1 and SW2 with a down-going pulse. SW1 has opened and SW2 is still closed, as shown on rows 2C and 2D respectively. Time is required for R1 to conduct enough charge to C1 to fill up C1, so the logic level at IN1 is neither a full high nor a full low. After a delay, however, the logic level at IN1 will go low, as will be described below. Meanwhile, IN2 receives the full high signal shown on row 2H.

In time interval 6, OUT2 goes low to interrogate SW3 and SW4. SW3 has opened and SW4 is closed. The capacitor C3 requires some time to recharge after SW3 opens, and during that delay the signal at IN1 is neither a full high nor a full low (row 2G). IN2 exhibits a full high signal in interval 6.

In time interval 7, SW1 and SW2 are examined, by closure of the semiconductor switch 24. SW1 remains open and SW2 has opened recently. IN1 has a low signal. IN2 has an intermediate-level signal due to the charging time of the capacitor C2 through resistor R2, as shown in row 2H of FIG. 2.

In time interval 8, OUT2 goes low to interrogate SW3, which is still open, and SW4, which opened recently. As shown on rows 2G and 2H, IN1 has a low signal and IN2 has a signal between a logic 1 and a logic 0.

In time interval 9, OUT1 interrogates switches 1 and 2. By that time all of the switches are open, all of the capacitors are fully charged, and both IN1 and IN2 have low logic levels.

Other Embodiments

The foregoing description of the preferred embodiment of the invention is merely one example utilizing the inventive concepts disclosed herein. The multiplexing situation and circuit details described here represent only that embodiment. Many variations are possible utilizing the invention. For example, the 2×2 matrix of multiplexing of switches can be expanded. The description and figures of the example do not limit the scope of the invention, which is defined by the claims.

What is claimed is:

1. Apparatus for computer-detection of whether electrical switch contacts (SW1) are open or closed, wherein the contacts were initially contaminated, comprising:

a programmed computer (1B) having a command-output terminal (OUT1) and a data-input terminal (IN1);

a first switch having contacts (SW1);

an impedance (R1) connected in series with said contacts;

a power source (14) connected in series with said contacts and said impedance (R1);

a capacitor (C1) connected in parallel across said contacts;

a second switch (24) in series connection with said power source (14) and said first switch contacts (SW1), and controllable by a computer command from said command-output terminal (OUT1) to open and close;

said computer (18) being programmed for initially closing said second switch a first time to charge said capacitor (C1) while said first switch contacts (SW1) are open, and for, at a programmed later time, closing said second switch (24) a second time to test whether said first switch contacts (SW1) are then open or closed;

a second power source (22) of lower voltage than said first power source (14);

circuit means (D1, 20) connected to be powered by said second power source, for detecting whether or not current is flowing through said first switch contacts (SW1) upon said second closure of said second switch (24), and providing a closed-or-open status signal accordingly;

input means (IN1) connected with said circuit means (D1, 20) for inputting said closed-or-open status signal of said first switch contacts (SW1) to said computer (18).

2. Apparatus as in claim 1 and wherein said circuit means comprises blocking-diode means.

3. Apparatus as in claim 1 and wherein said second switch (24) comprises a semiconductor switch.

4. A method for computer-detection of whether electrical switch contacts (SW1) are open or closed, wherein the contacts were initially oxidized, comprising the steps of:

programming a computer (18) having a command-output terminal (OUT1) and a data-input terminal (IN1);

connecting a capacitor (C1) in parallel combination with said contacts and connecting an impedance (R1) in series with said parallel combination;

while said contacts (SW1) are open, computer-commanding (OUT1) the charging of said capacitor, with current conducted through said impedance, to a first voltage (14);

closing said contacts (SW1) whereby to discharge said capacitor through said contacts with a transient current adequate to clean said contacts;

at a computer-programmed time thereafter, computer-commanding (OUT1) the application of said first voltage (14) to said switch contacts (SW1) and impedance (R1), to produce, if said contacts (SW1) are closed, a test current therethrough;

detecting for the presence of said test current by means of a circuit having a lower voltage (22) than said first voltage (14), and providing an open-or-closed switch-status signal accordingly to said computer data-input terminal (IN1).

* * * * *